US010312011B2

(12) United States Patent
Choi

(10) Patent No.: US 10,312,011 B2
(45) Date of Patent: Jun. 4, 2019

(54) ALUMINUM COIL ASSEMBLY HAVING GALVANIC CORROSION PREVENTION STRUCTURE FOR CAR ELECTROMAGNETIC CLUTCH

(71) Applicant: SHILLA INDUSTRY CO., LTD., Gyeongsangbuk-do (KR)

(72) Inventor: Byoung Sun Choi, Gyeongsangbuk-do (KR)

(73) Assignee: SHILLA INDUSTRY CO., LTD., Gyeongsangbuk-Do (KR)

( * ) Notice: Subject to any disclaimer, the term of this patent is extended or adjusted under 35 U.S.C. 154(b) by 78 days.

(21) Appl. No.: 15/791,128

(22) Filed: Oct. 23, 2017

(65) Prior Publication Data

US 2019/0122804 A1 Apr. 25, 2019

(51) Int. Cl.
*H01F 27/04* (2006.01)
*H01F 27/29* (2006.01)

(52) U.S. Cl.
CPC ..... *H01F 27/04* (2013.01); *H01F 27/29* (2013.01)

(58) Field of Classification Search
CPC ..... H01F 27/04; H01F 27/29
USPC ..... 336/90, 92, 96, 98, 192, 200, 232
See application file for complete search history.

(56) References Cited

U.S. PATENT DOCUMENTS 7,746,204 B2 * 6/2010 Oh ..... F16D 27/112 192/84.96
2009/0253548 A1 * 10/2009 Showalter ..... B60K 17/165 475/225

* cited by examiner

*Primary Examiner* — Tszfung J Chan
(74) *Attorney, Agent, or Firm* — IPLA P.A.; James E. Bame

(57) ABSTRACT

An aluminum coil assembly includes: a steel housing; an aluminum electromagnetic coil electrically connected to the steel housing and having an aluminum lead coil and a copper ground coil connected to the aluminum lead coil by means of soldering or a terminal; and a brass ground ring adapted to be press-fitted to a ring hole formed on the steel housing and having a ground hole formed on the center thereof in such a manner as to insert the copper ground coil connected to the aluminum lead coil thereinto, a cylindrical portion having a cut line adapted to be reduced when coupled to the ring hole of the steel housing to support the copper ground coil inserted into the ground hole, and an inclined portion formed on the underside of the cylindrical portion to allow easy press-fitting to the ring hole formed on the steel housing.

1 Claim, 5 Drawing Sheets

ALUMINUM COIL ASSEMBLY HAVING GALVANIC CORROSION PREVENTION STRUCTURE FOR CAR ELECTROMAGNETIC CLUTCH

BACKGROUND

The present invention relates to an aluminum coil assembly having a galvanic corrosion prevention structure for a car electromagnetic clutch, and more particularly, to an aluminum coil assembly having a galvanic corrosion prevention structure for a car electromagnetic clutch that is capable of preventing the occurrence of galvanic corrosion on a structure where an aluminum electromagnetic coil comes into electrical contact with a steel housing by means of a ground ring.

BACKGROUND OF THE RELATED ART

As well known, a car electromagnetic clutch is used as means for controlling power from a driving side to a driven side so as to perform power transmission or cut-off in an air conditioner compressor or full-time four wheel driving switching device.

When electricity is supplied or cut off to or from a coil assembly as a main part of such car electromagnetic clutch, a magnetic field is formed or disappears from the coil assembly wound onto a bobbin by means of electromagnetic induction, and according to the formation or disappearance of the magnetic field, the electromagnetic clutch operates to transmit or cut off the power from the driving side to the driven side.

A main part of the electromagnetic clutch coil assembly having the above-mentioned operation is the electromagnetic coil wound onto the bobbin, and the electromagnetic coil is made of a copper or aluminum coil adapted to allow the magnetic field to be formed or disappear by means of the electromagnetic induction.

If the electromagnetic coil constituting the electromagnetic clutch coil assembly is made of the copper coil, the copper coil comes into contact with a steel housing through a ground ring made of a brass material, and even if the coil assembly is exposed to a corrosion environment, accordingly, the copper coil has the highest electric potential to cause no corrosion, so that there is no danger of losing electrical functions of the electromagnetic coil.

However, the copper coil constituting the electromagnetic coil is heavy in weight and high in manufacturing cost, and so as to achieve the product lightness and the cost reduction of the coil assembly, accordingly, the copper coil has been recently changed into an aluminum coil.

By the way, the aluminum coil is a metal having a relatively low electric potential, and if exposed to a corrosion environment, the aluminum coil becomes under galvanic corrosion, so that it is oxidized upon the contact with air, which causes poor contact. Accordingly, the aluminum coil loses the electrical functions thereof to give serious defects to the electromagnetic clutch coil assembly.

The galvanic corrosion is an electrochemical reduction-oxidation process occurring if two dissimilar metals having different electric potentials are in electrical contact with each other, in the presence of an electrolyte, thereby accelerating the corrosion of the two dissimilar metals.

SUMMARY OF THE INVENTION

Accordingly, the present invention has been made in view of the above-mentioned problems occurring in the prior art, and it is an object of the present invention to provide an aluminum coil assembly that is capable of removing the disadvantages of a copper coil, that is, heavy weight and high manufacturing cost, thereby achieving the lightness and cost reduction thereof.

It is another object of the present invention to provide an aluminum coil assembly that is capable of providing a self-contact type structure wherein galvanic corrosion of a car electromagnetic clutch is prevented even if an electromagnetic coil is made of an aluminum coil, thereby achieving the product lightness and cost reduction thereof.

To accomplish the above-mentioned objects, according to the present invention, there is provided an aluminum coil assembly having a galvanic corrosion prevention structure for a car electromagnetic clutch, the aluminum coil assembly including: a steel housing; an aluminum electromagnetic coil electrically connected to the steel housing and having an aluminum lead coil and a copper ground coil connected to the aluminum lead coil by means of soldering or a terminal; and a brass ground ring adapted to be press-fitted to a ring hole formed on the steel housing and having a ground hole formed on the center thereof in such a manner as to insert the copper ground coil connected to the aluminum lead coil thereinto, a cylindrical portion having a cut line adapted to be reduced when coupled to the ring hole of the steel housing to support the copper ground coil inserted into the ground hole, and an inclined portion formed on the underside of the cylindrical portion to allow easy press-fitting to the ring hole formed on the steel housing.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
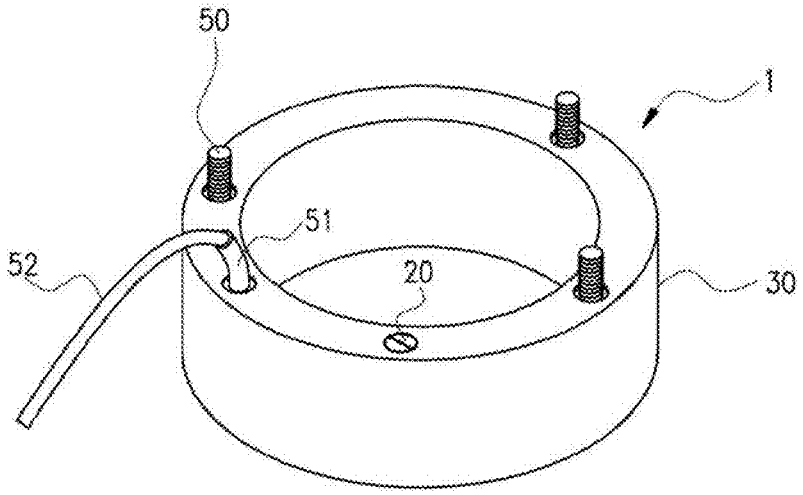
FIG. 1 is a perspective view showing an aluminum coil assembly according to the present invention.
Figure 2:
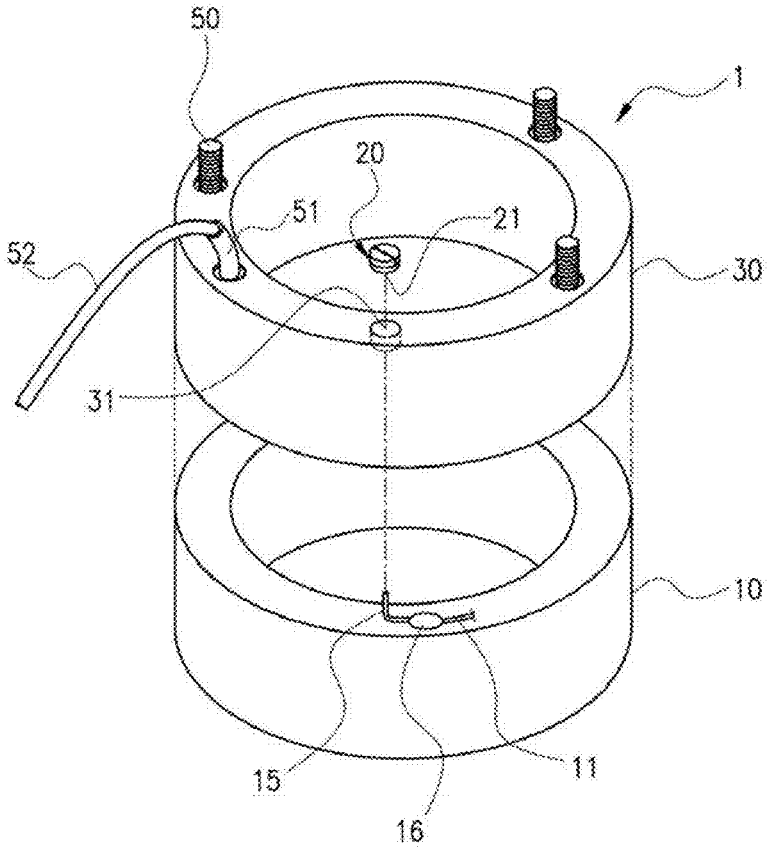
FIG. 2 is an exploded perspective view showing the aluminum coil assembly according to the present invention.
Figure 3:
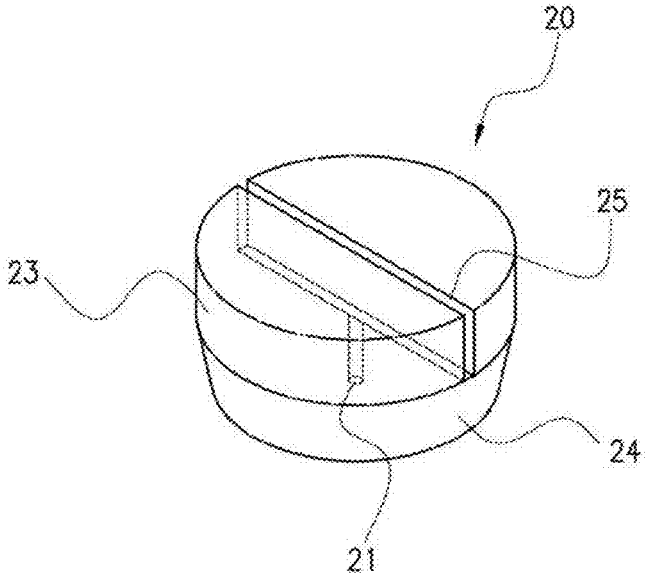
FIG. 3 is a perspective view showing a brass ground ring adapted to allow a copper ground coil to come into contact with a steel housing in the aluminum coil assembly according to the present invention.
Figure 4:
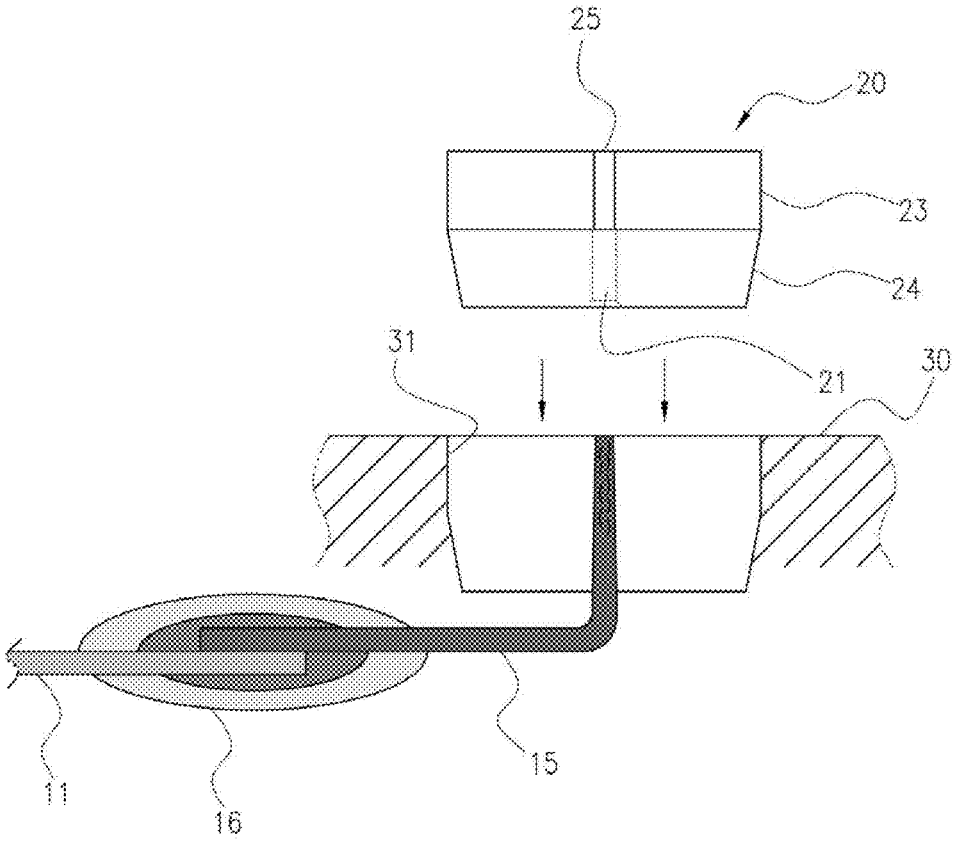
FIG. 4 is a sectional view showing the state where the copper ground coil bonded to an aluminum lead coil comes into contact with the steel housing, together with the brass ground ring.
Figure 5:
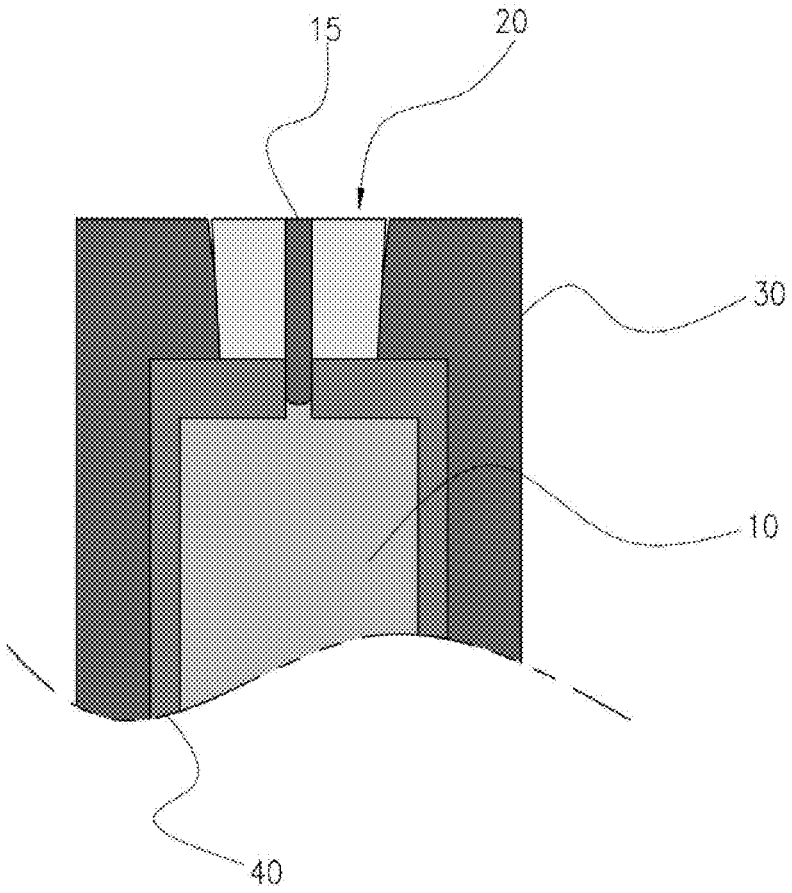
FIG. 5 is a sectional view showing the state where the copper ground coil comes into contact with the steel housing, together with the brass ground ring.

Hereinafter, an explanation on an aluminum coil assembly having a galvanic corrosion prevention structure for a car electromagnetic clutch according to the present invention will be given in detail with reference to the attached drawings.

According to the present invention, an aluminum coil assembly having a galvanic corrosion prevention structure for a car electromagnetic clutch includes an electromagnetic coil 1 for generating an electromagnetic force, a steel housing 30 for forming an outer shape of the electromagnetic coil 1 in such a manner as to be electrically grounded, a copper ground coil 15 connected to an aluminum lead coil 11 of an aluminum electromagnetic coil 10 by means of soldering or a terminal 16, a brass ground ring 20 adapted to allow the copper ground coil 15 to come into contact with the steel housing 30, and an epoxy molding material 40 for fixing the aluminum electromagnetic coil 10 to the steel housing 30.

So as to electrically connect the aluminum electromagnetic coil 10 to the steel housing 30, the aluminum lead coil 11 of the aluminum electromagnetic coil 10 is connected to the copper ground coil 15 by means of soldering or the terminal 16.

So as to allow the copper ground coil 15 connected to the aluminum lead coil 11 by means of the soldering or terminal 16 to come into contact with the steel housing 30, the steel housing 30 has a ring hole 31 formed thereon to couple the brass ground ring 20 thereto and at the same time to contactedly insert the copper ground coil 15 connected to the aluminum lead coil 11 by means of the soldering or terminal 16 into a ground hole 21 formed on the brass ground ring 20.

The brass ground ring 20 includes the ground hole 21 formed on the center thereof in such a manner as to come into contact with the copper ground coil 15 connected to the aluminum lead coil 11 by means of the soldering or terminal 16 if coupled to the ring hole 31 of the steel housing 30, a cylindrical portion 23 having a cut line 25 adapted to be reduced if coupled to the ring hole 31 of the steel housing 30 to support the copper ground coil 15 inserted into the ground hole 21, and an inclined portion 24 formed on the underside of the cylindrical portion 23 to allow the coupling to the ring hole 31 of the steel housing 30 to be easily performed.

A reference numeral 50 not explained yet indicates a screw for fixing the aluminum coil assembly, 51 indicates a grommet, and 52 indicates a power lead coil.

Under the above-mentioned structure, now, an explanation on the operation of the aluminum coil assembly having the galvanic corrosion prevention structure for the car electromagnetic clutch according to the present invention will be given in detail.

According to the present invention, the aluminum lead coil 11 of the aluminum electromagnetic coil 10 and the copper ground coil 15 are connected to each other by means of soldering or the terminal 16 and buried by the epoxy molding material 40, so that through complete sealing, ionic paths (electrolyte, moisture and so on) can be blocked from the outside to completely prevent the galvanic corrosion from occurring on the aluminum lead coil 11.

The brass ground ring 20, which is adapted to allow the copper ground coil 15 connected to the aluminum lead coil 11 to be grounded to the steel housing 30, is configured to insert the copper ground coil 15 into the ground hole 21 formed on the center thereof, so that as the brass ground ring 20 is press-fitted to the ring hole 31 of the steel housing 30, a space formed by the cut line 25 of the cylindrical portion 23 becomes reduced to support and firmly fix the copper ground coil 15 inserted into the ground hole 21.

When the brass ground ring 20 is coupled to the ring hole 31 of the steel housing 30 in such a manner as to be press-fitted to the ring hole 31 of the steel housing 30 to support the copper ground coil 15 inserted into the ground hole 21, easy coupling of the brass ground ring 20 to the ring hole 31 of the steel housing 30 is achieved by the inclined portion 24 formed on the underside of the cylindrical portion 23.

After the aluminum lead coil 11 of the aluminum electromagnetic coil 10 is electrically connected to the copper ground coil 15 by means of the soldering or terminal 16, without coming into direct contact with the steel housing 30, the copper ground coil 15 is compressed by means of the brass ground ring 20 and thus comes into contact with the aluminum lead coil 11 to perfectly block ionic paths from the outside, so that the occurrence of the galvanic corrosion on the connected portion of the copper ground coil 15 to the aluminum lead coil 11 can be completely prevented.

As described above, the aluminum coil assembly according to the present invention can block the ionic paths (electrolyte, moisture and so on) from the outside even if the aluminum coil and the copper coil come into direct electrical contact with each other, so that the galvanic corrosion of the aluminum electromagnetic coil is prevented to keep the electrical functions from being lost due to contact resistance defects.

In addition, the aluminum coil assembly according to the present invention can provide the car electromagnetic clutch having the aluminum electromagnetic coil, thereby achieving the lightness and cost reduction of the car electromagnetic clutch and improving the quality and reliability thereof.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An aluminum coil assembly having a galvanic corrosion prevention structure for a car electromagnetic clutch, the aluminum coil assembly comprising:

a steel housing;

an aluminum electromagnetic coil electrically connected to the steel housing and having an aluminum lead coil and a copper ground coil connected to the aluminum lead coil by means of soldering or a terminal; and a brass ground ring adapted to be press-fitted to a ring hole formed on the steel housing and having a ground hole formed on the center thereof in such a manner as to insert the copper ground coil connected to the aluminum lead coil thereinto, a cylindrical portion having a cut line adapted to be reduced when coupled to the ring hole of the steel housing to support the copper ground coil inserted into the ground hole, and an inclined portion formed on the underside of the cylindrical portion to allow easy press-fitting to the ring hole formed on the steel housing.

* * * * *